US007961893B2

(12) United States Patent
Kino

(10) Patent No.: US 7,961,893 B2
(45) Date of Patent: Jun. 14, 2011

(54) MEASURING APPARATUS, MEASURING METHOD, AND SOUND SIGNAL PROCESSING APPARATUS

(75) Inventor: Yasuyuki Kino, Tokyo (JP)

(73) Assignee: Sony Corporation, Tokyo (JP)

( * ) Notice: Subject to any disclaimer, the term of this patent is extended or adjusted under 35 U.S.C. 154(b) by 1205 days.

(21) Appl. No.: 11/539,005

(22) Filed: Oct. 5, 2006

(65) Prior Publication Data

US 2007/0086596 A1 Apr. 19, 2007

(30) Foreign Application Priority Data

Oct. 19, 2005 (JP) ..... 2005-304760

(51) Int. Cl.
*H04R 29/00* (2006.01)

(52) U.S. Cl. ..... 381/59; 381/56; 381/58; 381/303; 381/26

(58) Field of Classification Search ..... 381/56–59, 381/103, 303–304, 96, 26
See application file for complete search history.

(56) References Cited

U.S. PATENT DOCUMENTS

| | | | | |
|---|---|---|---|---|
| 7,158,643 | B2 * | 1/2007 | Lavoie et al. | 381/58 |
| 7,587,053 | B1 * | 9/2009 | Pereira | 381/77 |
| 2001/0016045 | A1 * | 8/2001 | Ohta | 381/98 |
| 2002/0159602 | A1 * | 10/2002 | Yoshino et al. | 381/59 |

FOREIGN PATENT DOCUMENTS

JP 06-186328 7/1994

* cited by examiner

*Primary Examiner* — Devona E Faulk
*Assistant Examiner* — Disler Paul
(74) *Attorney, Agent, or Firm* — Oblon, Spivak, McClelland, Maier & Neustadt, L.L.P.

(57) ABSTRACT

A measuring apparatus that measures sound arrival delay time from a speaker to a microphone on the basis of a result obtained by collecting signals output from the speaker by means of the microphone includes: measuring means for measuring the sound arrival delay time that makes a control such that a first sine wave signal having a first frequency and a second sine wave signal having a second frequency different from the first frequency are output from the speaker, is input with the first sine wave signal and the second sine wave signal collected by the microphone and then mixes the first sine wave signal and the second sine wave signal so as to generate a third sine wave signal having a frequency corresponding to a difference between the first frequency and the second frequency, and measures the sound arrival delay time on the basis of the third sine wave signal.

8 Claims, 12 Drawing Sheets

MEASURING APPARATUS, MEASURING METHOD, AND SOUND SIGNAL PROCESSING APPARATUS

CROSS REFERENCES TO RELATED APPLICATIONS

The present invention contains subject matter related to Japanese Patent Application JP 2005-304760 filed in the Japanese Patent Office on Oct. 19, 2005, the entire contents of which being incorporated herein by reference.

BACKGROUND OF THE INVENTION

1. Field of the Invention

The present invention relates to measuring apparatus and method of measuring sound arrival delay time from a speaker to a microphone on the basis of a result obtained by collecting a signal output from the speaker by means of the microphone. In addition, the invention relates to a sound signal processing apparatus having a function of measuring the sound arrival delay time.

2. Description of the Related Art

In the related art, particularly in an audio system that outputs audio signals through multi-channels, a method has been known in which a test signal, such as a sine wave signal or a TSP (time stretched pulse) signal, is output from a speaker and the test signal is collected by a microphone that is separately provided, and on the basis of a result of the collected signal, delay time (sound arrival delay time) until a sound output from the speaker arrives at the microphone is measured.

FIGS. 13A and 13B illustrate an example of the method described above.

Here, in FIGS. 13A and 13B, a case of using a sine wave signal as the test signal is shown.

First, referring to FIG. 13A, a sine wave signal having a predetermined frequency is output as an output signal, which is shown in the drawing, from a speaker (point of time t1).

At a point of time t2, which is located apart from the output start point t1 of the sine wave signal by a predetermined period of time, the sine wave signal starts to be collected by a microphone, which is shown as a collected signal in the drawing. That is, a period of time between these points of time t1 and t2 is the sound arrival delay time until a sound output from the speaker arrives at the microphone (actual delay time in the drawing).

In addition, as an actual measuring operation, first, as shown as an input signal for measurement in the drawing, for example, input of the collected signal starts at a timing synchronized with a start timing of one period of the output signal (point of time t3). The input of the collected signal is performed during a predetermined period of time that is set beforehand. For example, in this case, the sine wave signal is input during one period, as shown in the drawing.

Here, assuming that the distance between the speaker and the microphone is zero, a waveform of the output signal becomes the same as that of the collected signal, the input of the collected signal being started in synchronization with the start timing of the output signal as described above. This is because, if the distance between the speaker and the microphone is zero, the beginning position (0-th clock) of an input signal should be the start position of a waveform of the input signal.

In other words, if the distance between the speaker and the microphone is not zero, the start position of the waveform of the input signal will be obtained by shifting the waveform of the input signal from the 0-th clock. Therefore, if the collected signal is input by making an input start timing synchronized with a start timing of one period of an output signal (that is, the start position of a waveform of an output signal), it is possible to measure the sound arrival delay time by examining how far the start position of the waveform of the input signal is from the 0-th clock.

That is, referring to FIG. 13A, a 0-th clock of the input signal corresponds to the point of time t3 and the start position of the waveform of the input signal corresponds to the point of time t4. Accordingly, it is possible to measure the sound arrival delay time by measuring a period of time between the points of time t3 and t4.

In the above-described method of measuring the delay time, it may be considered that the delay time is measured on the basis of a phase difference between the output signal and the collected signal.

However, in the measuring method described above, there is a limit that the delay time is measured, at the most, up to only a range not exceeding one period length of a sine wave signal.

FIG. 13B illustrates an example in which delay time is longer than one period length of a sine wave signal. In the case in which the delay time is longer than one period, since it is not possible to check to which period the start position of an input waveform corresponds, the delay time cannot be properly measured. In the example shown in FIG. 13B, the delay time measured corresponding to actual delay time (between points of time t1 and t10) is a period of time between points of time t11 and t12 indicating the phase difference between the output signal and the collected signal.

Therefore, in a method of the related art in which the sine wave signal is used, the delay time cannot be properly measured if the delay time is not within a range of one period length. In other words, in the method of using the sine wave signal described above, one period length (that is, frequency) of a sine wave signal is selected depending on the distance between a speaker and a microphone, which are objects to be measured, such that the delay time can be measured.

In addition, the related art includes JP-A-2003-061199 and JP-A-2005-236502.

SUMMARY OF THE INVENTION

However, selecting the frequency of a used sine wave signal depending on the distance between the speaker and the microphone, which are objects to be measured, means that measurable delay time length may be limited to a frequency band that can be output by a used speaker.

For example, in the case when the distance between the speaker and the microphone is relatively long, a sine wave signal having a relatively low frequency is selected. However, in this case, for example, if the speaker is adapted for a high band, there is a possibility that the delay time related to the relatively long distance between the speaker and the microphone will not be measured.

In other words, in this case, in order to properly measure the delay time, a speaker to be used should be limited to a speaker adapted for a low band.

Furthermore, in the related art, as a method of measuring the delay time by using a test signal, there is a method of using the above-mentioned TSP signal. However, the TSP signal has a characteristic of being output over approximately the entire bands. For this reason, the method cannot be applied to a speaker, such as a sub-woofer, from which only a low-band signal is output. Accordingly, there is a possibility that only a limited number of speakers will use the method of using the TSP signal.

In addition, in the method of using the TSP signal, since a relatively high-level processing, such as FFT (fast Fourier transform) or IFFT (inverse fast Fourier transform), is required to measure the delay time, there is a problem in that high-performance hardware resources are needed.

Therefore, in view of the above, it is desirable to configure a measuring apparatus as follows.

According to an embodiment of the invention, there is provided a measuring apparatus for measuring sound arrival delay time from a speaker to a microphone on the basis of a result obtained by collecting signals output from the speaker by means of the microphone. The measuring apparatus according to the embodiment of the invention includes: measuring means for measuring the sound arrival delay time that makes a control such that a first sine wave signal having a first frequency and a second sine wave signal having a second frequency different from the first frequency are output from the speaker, is input with the first sine wave signal and the second sine wave signal collected by the microphone and then mixes the first sine wave signal and the second sine wave signal so as to generate a third sine wave signal having a frequency corresponding to a difference between the first frequency and the second frequency, and measures the sound arrival delay time on the basis of the third sine wave signal.

Further, according to another embodiment of the invention, there is provided a sound signal processing apparatus configured as follows.

That is, the sound signal processing apparatus according to another embodiment of the invention has a measuring function of measuring sound arrival delay time from a speaker to a microphone on the basis of a result obtained by collecting signals output from the speaker by means of the microphone, and includes: measuring means for measuring the sound arrival delay time that makes a control such that a first sine wave signal having a first frequency and a second sine wave signal having a second frequency different from the first frequency are output from the speaker, is input with the first sine wave signal and the second sine wave signal collected by the microphone and then mixes the first sine wave signal and the second sine wave signal so as to generate a third sine wave signal having a frequency corresponding to a difference between the first frequency and the second frequency, and measures the sound arrival delay time on the basis of the third sine wave signal.

In addition, the sound signal processing apparatus includes a delay time adjustment unit that adjusts delay time with respect to sound signals, which are to be output from the speaker, on the basis of the sound arrival delay time measured by the measuring means.

According to the above-described embodiments of the invention, since measurable delay time can be set to correspond to one period length of the third sine wave signal having a frequency corresponding to the difference between the first frequency and the second frequency, it is possible to measure long delay time without being limited to frequencies of sine wave signals output from the speaker.

As described above, according to the embodiments of the invention, it is possible to measure long delay time without being limited to a frequency of a sine wave signal output from the speaker. That is, from the point of view described above, the delay time can be measured without being limited to the type of a speaker that is used.

Furthermore, in order to realize the above-described delay time measurement according to the embodiments of the invention, a process of mixing sine wave signals is needed unlike in the method used in the related art. However, as for the mixing process, it is sufficient to perform a relatively simple operation based on equation using trigonometric function. Other than the mixing process, the delay time measurement can be realized only with a simple process including the output of a sine wave signal, the input of a collected signal, and the time measurement. Thus, according to the above-described embodiments of the invention, a high-performance process is not needed, and as a result, the embodiments of the invention may be properly applied to even an apparatus having relatively insufficient hardware resources.

Furthermore, in the sound signal processing device according to the embodiment of the invention, it is possible to adjust the delay time with respect to sound signals, which are to be output from the speaker, on the basis of the delay time measured by using the above-described method according to the embodiment of the invention.

DESCRIPTION OF THE PREFERRED EMBODIMENTS

Hereinafter, best mode (hereinafter, referred to as 'embodiment') for carrying out the invention will be described.

Figure 1:
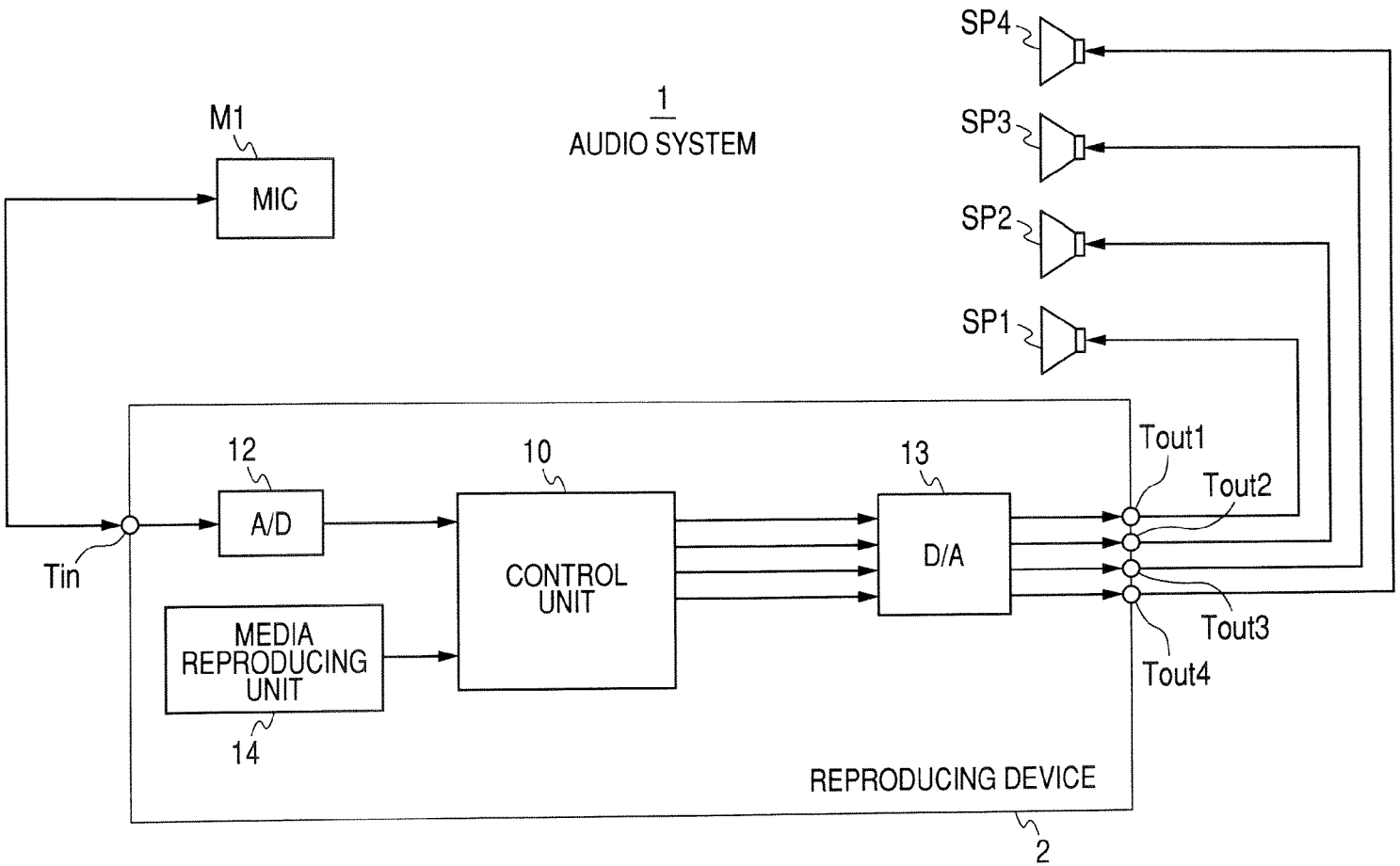
FIG. 1 is a block diagram illustrating the internal configuration of a sound signal processing apparatus according to an embodiment of the invention and the configuration of an audio system including the sound signal processing apparatus, a speaker, and a microphone.

FIG. 1 is a view illustrating the internal configuration of a reproducing device 2, which serves as a sound signal processing apparatus according to an embodiment of the invention, and the configuration of an audio system 1 including the reproducing device 2.

Referring to FIG. 1, the reproducing device 2 according to the embodiment of the invention includes a media reproducing unit 14 that is shown in the drawing, and thus may perform a reproducing operation with respect to a required recording medium, for example, an optical disc recording medium such as a CD (compact disc), a DVD (digital versatile disc), or a Blu-ray disc, a magnetic disc such as an MD (mini disc: magneto-optical disc) or a hard disc, and a recording medium having a semiconductor memory stored therein.

The audio system 1 according to the embodiment includes a plurality of speakers SP (SP1, SP2, SP3, and output audio signals (sound signals) reproduced by the media reproducing unit 14 of the reproducing device 2. In addition, the audio system 1 includes a microphone (MIC) M1, which is shown in the drawing, necessary to perform delay time measurement to be described later.

For example, a car audio system or a 5.1 channel surround system may be applied as the audio system 1 according to the embodiment.

Here, even though the number of speakers SP is set to 4, this is only to indicate that the number of speakers other words, the number of speakers SP is not limited to 4.

The reproducing device 2 includes a sound input terminal Tin to which sound signals collected by the microphone M1 are input and is connected to the microphone M1 through the sound input terminal Tin.

Further, the reproducing device 2 includes a plurality of sound output terminals Tout1 to Tout4 corresponding to the number of plurality of speakers SP1 to SP4, and the reproducing device 2 is connected to the speakers SP1 to SP4 through the sound output terminals Tout1 to Tout4.

Collected signals, which are input from the microphone through the sound input terminal Tin, are input to a control unit 10 through an A/D converter 12.

In addition, by the control unit 10, a plurality of sound signals corresponding to the number of speakers SP in this case are supplied to the corresponding sound output terminals Tout1 to Tout4 through a D/A converter 13.

The control unit 10 is configured to have, for example, a DSP (digital signal processor) or a CPU (central processing unit) such that various functional operations to be described later can be realized.

Although not shown, the control unit 10 includes a memory, such as a ROM or a RAM. For example, the ROM stores parameters, coefficients, or programs which allow the control unit 10 to perform various control processes. In addition, the RAM temporarily holds, for example, work data of the control unit 10, and the RAM is used as a work region.

The media reproducing unit 14 performs a reproducing operation on a recording medium, as described above.

For example, in the case of a recording medium, such as the optical disc recording medium or the MD, the media reproducing unit 14 includes an optical head, a spindle motor, a reproduction signal processing unit, a servo circuit, and the like, and is configured to reproduce signals by irradiating a laser beam onto a mounted recording medium having a disc shape.

Then, audio signals obtained by performing the reproducing operation described above are supplied to the control unit 10.

Figure 2:
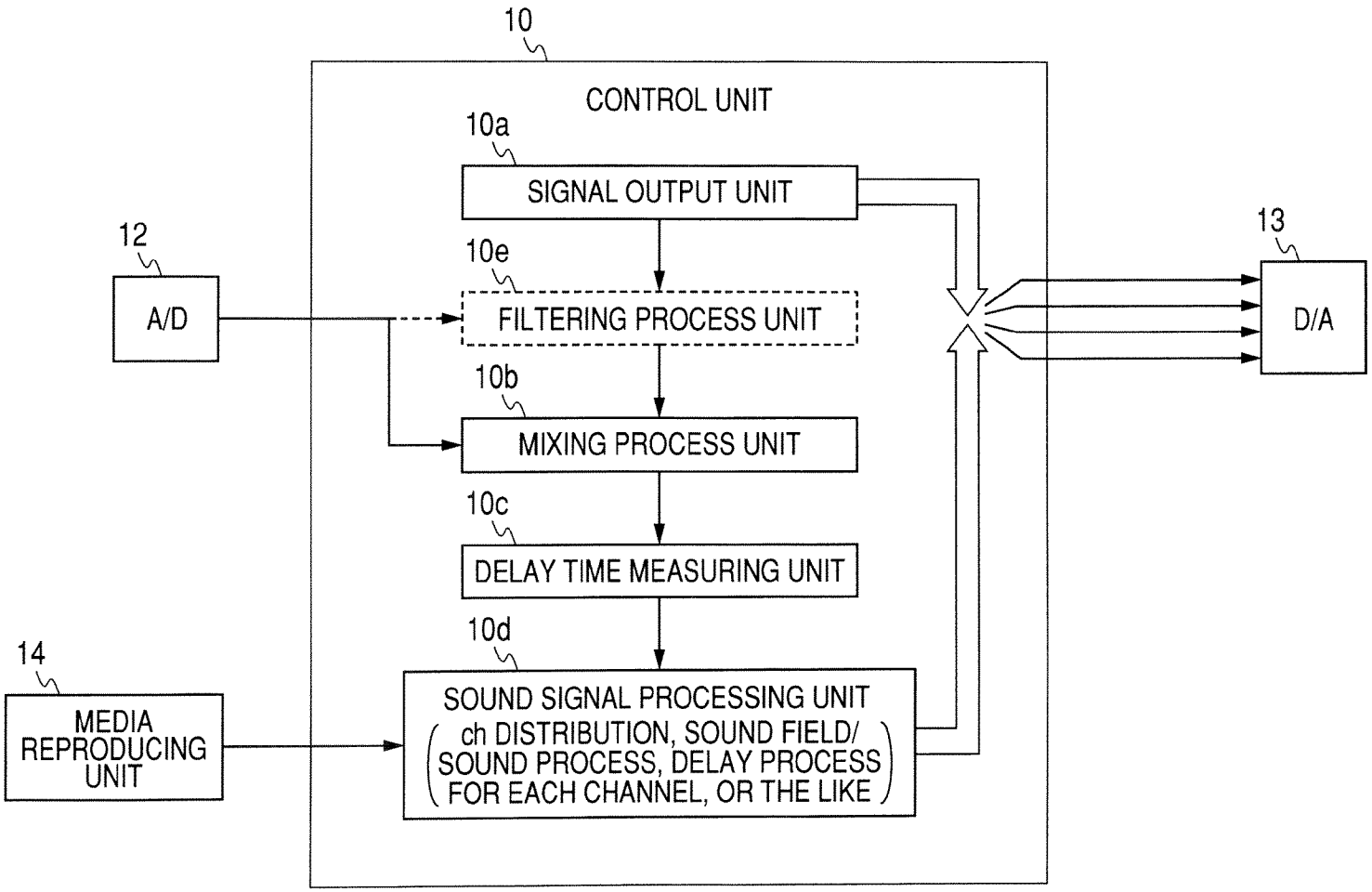
FIG. 2 is a view explaining various functional operations performed by a control unit included in the sound signal processing apparatus according to the embodiment of the invention.

FIG. 2 is a view explaining various functional operations realized by the control unit 10. Further, in FIG. 2, the various functional operations of the control unit 10 are shown by using blocks. Furthermore, in FIG. 2, the media reproducing unit 14, the A/D converter 12, and the D/A converter 13, which are shown in FIG. 1, are also shown.

Referring to FIG. 2, the control unit 10 has functions as a signal output unit 10*a*, a mixing process unit 10*b*, a delay time measuring unit 10*c*, and a sound signal processing unit 10*d*, as shown in the drawing.

In the embodiment, a case is exemplified in which the control unit 10 realizes the various functional operations by software processing; however, the various functional operations may be realized by configuring the functional blocks with hardware.

The signal output unit 10*a* outputs sine wave signals that are to be output from the speaker SP in a delay time measurement, which will be described later. The sine wave signals output from the signal output unit 10*a* are supplied to the speaker SP through the D/A converter 13 and the sound output terminal Tout, and thus sound signals based on the sine wave signals are output as a real sound from the speaker SP.

Here, the delay time measurement is performed for each speaker SP. Accordingly, the signal output unit 10*a* can output sine wave signals such that the output of the sine wave signals switch between channels corresponding to the speakers. That is, when a channel corresponding to the speaker SP1 is selected, the sine wave signal is output to a line connected to the sound output terminal Tout1, and when a channel corresponding to the speaker SP2 is selected, the sine wave signal is output to a line connected to the sound output terminal Tout2. In the same manner, when a channel corresponding to the speaker SP3 is selected, the sine wave signal is output to a line connected to the sound output terminal Tout3, and when a channel corresponding to the speaker SP4 is selected, the sine wave signal is output to a line connected to the sound output terminal Tout4.

The mixing process unit 10*b* is input with collected signals, which are output from the microphone M1 and are then supplied through the A/D converter 12, as collected signals with respect to the sine wave signals output from the speaker SP. As will be described later, in the present embodiment, at least two signals having different frequencies are output/collected as sine wave signals, and accordingly, these signals having different frequencies are input to the mixing process unit 10*b*. Then, the mixing process unit 10*b* mixes the two sine wave signals on the basis of equation, which will be described later, thereby generating a sine wave signal having a frequency corresponding to a difference between frequencies of the sine wave signals.

The delay time measuring unit 10*c* measures delay time (sound arrival delay time) DT until a sound output from the speaker SP arrives at the microphone M1, by measuring deviation starting from a 0-th clock with respect to the sine wave signal obtained by the mixing process of the mixing process unit 10*b*, the 0-th clock corresponding to the waveform start position of the sine wave signal.

As will be described later, even in the present embodiment, the input start timing of the collected signal is set to be synchronized with the start position of one period of the output sine wave signal. Accordingly, the delay time DT can be obtained by measuring the deviation starting from the 0-th clock (that is, position at which the input has started) with respect to the sine wave signal (reflecting phase of an input signal) obtained by the mixing process described above, the 0-th clock corresponding to the waveform start position of the sine wave signal.

The sound signal processing unit 10*d* performs a ch (channel) distribution process, a sound field/sound process, a delay process for each channel, or the like, which are shown in FIG. 2.

In the channel distribution process, a plurality of audio signals input from the media reproducing unit 14 is distributed and output to lines each of which is connected to the speaker SP (that is, corresponding sound output terminal Tout). For example, in the case when the audio system 1 is a car audio system, audio signals, which correspond to two channels Lch and Rch, reproduced by the media reproducing unit 14 are distributed and output to lines each of which is connected to the corresponding speaker SP (sound output terminal Tout corresponding to channels Lch and Rch).

Alternatively, in the case when the audio system 1 is a 5.1 ch surround system, when audio signals corresponding to two channels Lch and Rch are reproduced by the media reproducing unit 14, six kinds of audio signals corresponding to 5.1 ch are generated on the basis of the two kinds of audio signals. Then, the six kinds of audio signals are distributed and output to lines each of which is connected to the corresponding sound output terminal Tout.

Here, the sound field/sound process means, for example, a process of creating various sound effects by means of an equalizing process, or a process of creating sound field effect such as digital reverberation.

Furthermore, the delay process for each channel is a process of setting delay time with respect to an audio signal to be output from each speaker SP on the basis of the delay time DT, which corresponds to each speaker SP (each channel), measured by the delay time measuring unit 10*c* and then performing a delay process with respect to each audio signal according to the set delay time. That is, delay time with respect to an audio signal is adjusted depending on the measured delay time DT.

The adjustment of delay time for each channel is performed such that sounds output from the respective speakers SP simultaneously arrive at the microphone M1. Accordingly, in the case when the position where the microphone M1 is disposed is set to a listening position, it is possible to cause sounds output from the respective speakers SP to arrive at the listening position at the same time.

In addition, for a specific method of outputting sound signals output from the respective speakers SP after delaying the sound signals according to delay time, which has been measured for each speaker SP, there has been proposed various techniques. Accordingly, the method is not specifically limited.

Here, according to the above description, even in the present embodiment, it can be recognized that the measurement is performed on the basis of the phase difference between an output sine wave signal and a collected/input sine wave signal when measuring delay time.

As described earlier, in the method of measuring the delay time on the basis of the phase difference between the output signal and the collected/input signal, there is a limit that the delay time is measured, at the most, up to only delay time not exceeding one period length of a signal.

Accordingly, as also described earlier, in the related art, a frequency of a sine wave signal is selected depending on the distance between a speaker and a microphone to be measured. However, in this case, for example, if a speaker to be used is adapted for a high band, there is a possibility that the delay time with respect to the relatively long distance between the speaker and the microphone will not be measured. As a result, a problem occurs where the measurable delay time length may be limited due to a speaker that is used.

For this reason, in the present embodiment, a method is adopted in which sine wave signals having different frequencies are output, the sine wave signals are collected/input and then mixed so as to generate a sine wave signal having a frequency corresponding to a difference between the different frequencies, and then the delay time DT is measured on the basis of the sine wave signal obtained by the mixing process.

As the method described above, following first to third embodiments are proposed.

First Embodiment

Figure 3:
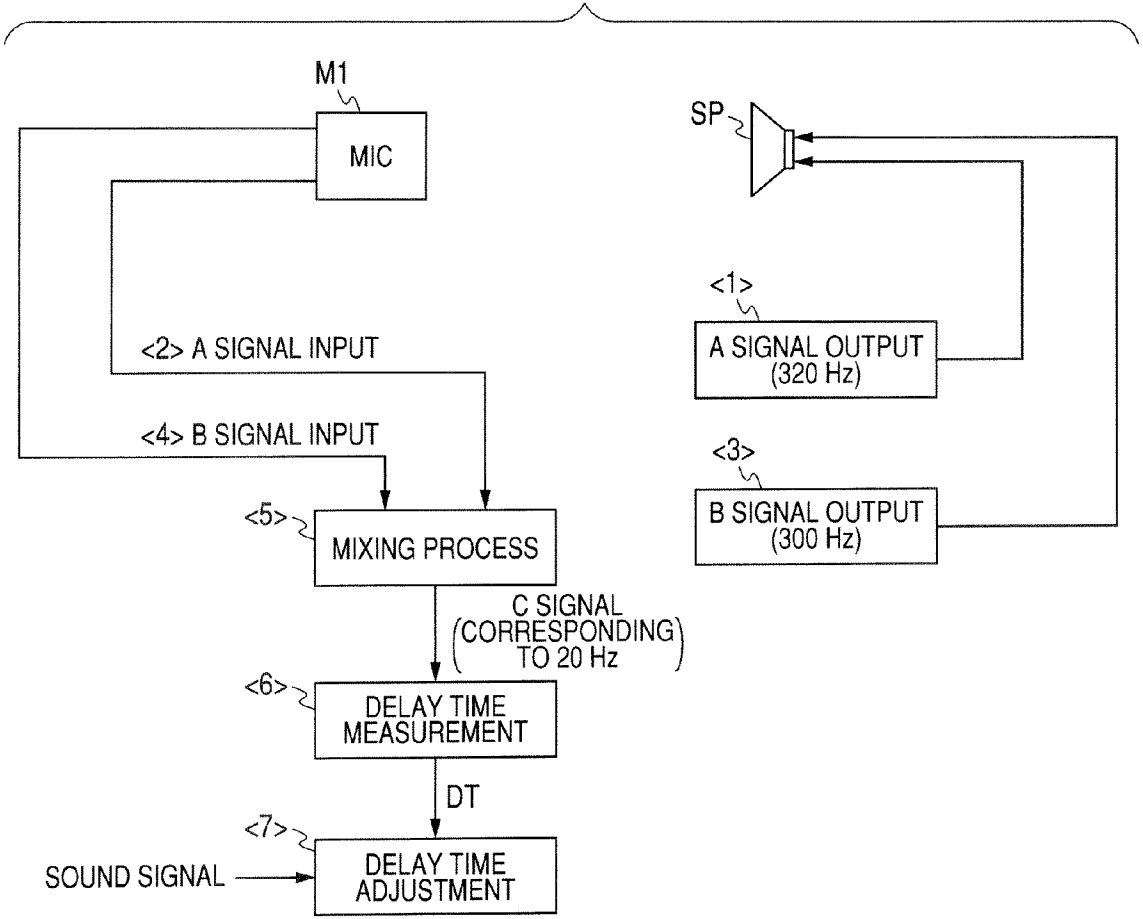
FIG. 3 is a view schematically explaining an operation of measuring delay time according to a first embodiment.

FIG. 3 is a view schematically explaining an operation of measuring delay time according to a first embodiment. Here, in the following description, only an operation of measuring delay time with respect to one speaker SP will be described for the convenience of explanation. However, in order to measure delay time with respect to the respective speakers SP, the same measuring operation may be repeatedly performed for the respective speakers SP.

First, in the first embodiment, an A signal (first sine wave signal) having a frequency of 320 Hz and a B signal (second sine wave signal) having a frequency of 300 Hz are set as sine wave signals having different frequencies. In addition, the A and B signals are sequentially output from the speaker SP, and collected signals corresponding to the sequentially output A and B signals are sequentially input.

That is, in this case, as shown by <1> in FIG. 3, for example, the A signal is output from the speaker SP. Then, a signal, which is collected by the microphone M1, corresponding to the A signal output from the speaker SP is input (<2> in FIG. 3) Subsequently, the B signal is output as shown by <3>in FIG. 3, and then a signal, which is collected by the microphone M1, corresponding to the B signal is input (<4> in FIG. 3).

Figure 13A:
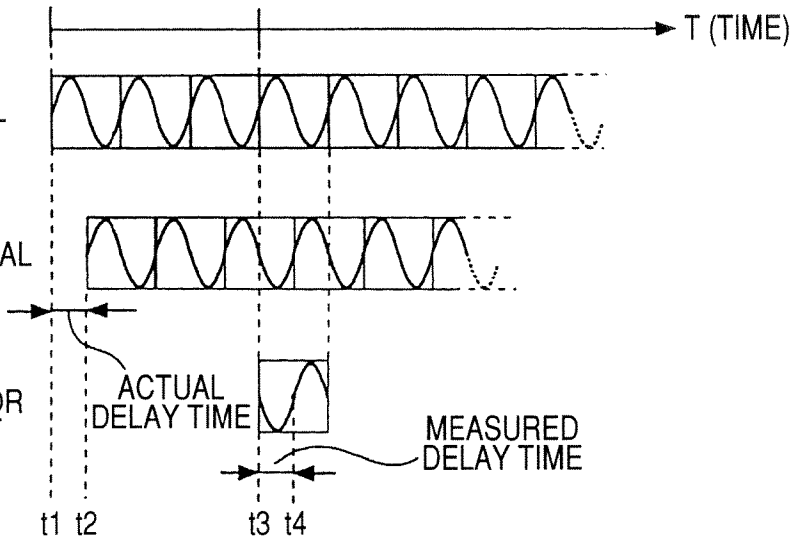
FIG. 13A is a view illustrating a delay time measuring operation using a sine wave signal as a test signal.
Figure 13B:
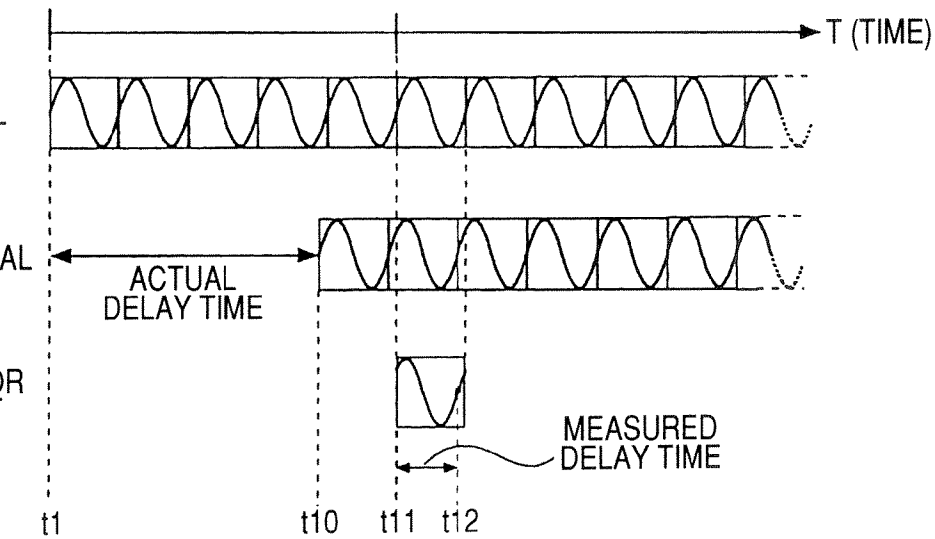
FIG. 13B is a view illustrating a delay time measuring operation using a sine wave signal as a test signal.

Here, even in the embodiment, the input start timing of a collected signal with respect to a sine wave signal output for the measurement described above is set to be synchronized with a start timing of one period of the output sine wave signal, in the same manner as the method in the related art shown in FIGS. 13A and 13B. Accordingly, in the same manner as the method in the related art, the delay time can be easily obtained by measuring deviation starting from a 0-th clock of a waveform, the 0-th clock corresponding to the start position of the waveform. In addition, in this case, at least one period of the sine wave signal is input as the collected signal.

After performing the output of the A signal, the input of the collected signal corresponding to the A signal, the output of the B signal, and the input of the collected signal corresponding to the B signal, the input A and B signals are mixed with each other in a mixing process shown by <5> in FIG. 3. Thus, by mixing signals having different frequencies, it is possible to obtain a signal (hereinafter, referred to as a 'C signal') having a frequency corresponding to a difference between the frequencies.

Here, the above-described generation of a signal having a frequency corresponding to a difference between different frequencies of the A and B signals is expressed by the following equation using trigonometric function.

$$\sin(A-B)=\sin(A)\cos(B)-\cos(A)\sin(B)$$

Here, assuming that a frequency of the A signal is 'a', a frequency of the B signal is 'b', an operating frequency (for example, 44.1 kHz in this case) of the control unit 10 is 'T', and elapsed time is 'x', the above equation can be expressed by the following equation 1.

$$\text{Sin}\{2\pi(a-b)x/T\}=\sin(2\pi ax/T)\cos(2\pi bx/T)-\cos(2\pi ax/T)\sin(2\pi bx/T) \quad \text{equation 1}$$

In this case, the frequency 'a' of the A signal is 320 and the frequency 'b' of the B signal is 300, and accordingly, the following equation is obtained by substituting in 'a' and 'b' with these numbers.

$$\sin\{2\pi 20x/T\}=\sin(2\cdot 320\pi x/T)\cos(2\cdot 300\pi x/T)-\cos(2\cdot 320\pi x/T)\sin(2\cdot 300\pi x/T)$$

This indicates that a signal having a frequency of 20 Hz can be generated by mixing a signal having a frequency of 320 Hz and a signal having a frequency of 300 Hz. Thus, it can be recognized that, by mixing the A and B signals having different frequencies, the C signal (third sine wave signal) having a frequency corresponding to a difference between the frequencies can be obtained.

In the above equation 1, the collected/input A signal corresponds to 'sin(2πax/T)'. In the same manner, the collected/input B signal corresponds to 'sin(2πbx/T)'. Therefore, in order to obtain the C signal in the mixing process, first, a signal corresponding to 'cos(2πax/T)' is generated by deviating the input A signal by ¼ wavelength, and in the same manner, a signal corresponding to 'cos(2πbx/T)' is generated by deviating the input B signal by ¼ wavelength. Thereafter, these signals of 'sin(2πax/T)'(that is, A signal), 'cos(2πax/T)', 'sin(2πbx/T)' (that is, B signal), and 'cos(2πbx/T)' are normalized so as to have predetermined wavelengths and then an operation with respect to these signals is performed by using the equation 1, thereby obtaining the C signal corresponding to sin {2π(a−b)×/T}.

Figure 4A:
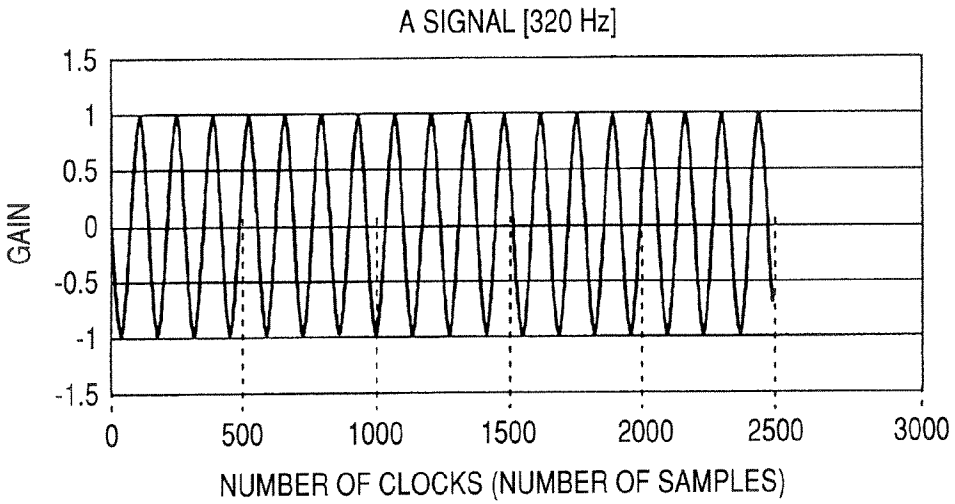
FIGS. 4A and 4B are views illustrating examples of waveforms of two sine wave signals (first sine wave signal and second sine wave signal) output from a speaker.
Figure 4B:
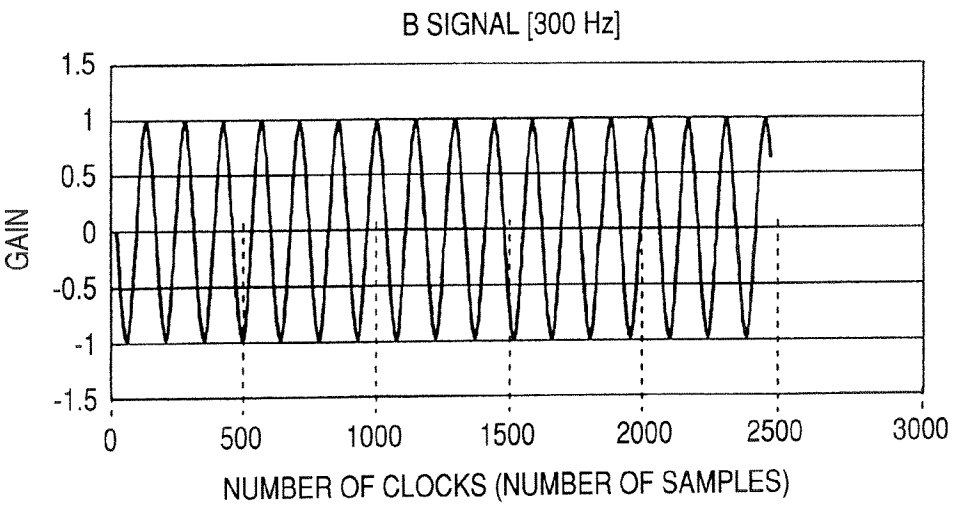

Here, FIGS. 4A and 4B illustrate waveforms of the A signal (320 Hz) and the B signal (300 Hz) in the case described above, and FIG. 5 illustrates waveform of the C signal (corresponding to 20 Hz) that is generated by mixing the A and B signals by means of an operation process based on the equation 1. In addition, in the drawings, a vertical axis indicates a gain (dB) and a horizontal axis indicates the number of clocks (number of samples). Moreover, in the drawings, the amplitude of each of the signals is normalized to range from −1.0 to 1.0.

In this case, each of the drawings illustrates a waveform of an input signal in the case in which the sound arrival delay time from the speaker SP to the microphone M1 corresponds to 2000 clocks. Accordingly, in each of the A and B signals shown in FIGS. 4A and 4B, the start position (start point at which a waveform rises under the state in which a gain is 0) of a waveform corresponds to a 2000-th clock.

However, in this case, 2000 clocks are longer than one period of the A signal and longer than one period of the B signal. Accordingly, when delay time is measured on the basis of only the A and B signals, it is not possible to check to which period the start position corresponds. As a result, the delay time cannot be properly measured.

Figure 5:
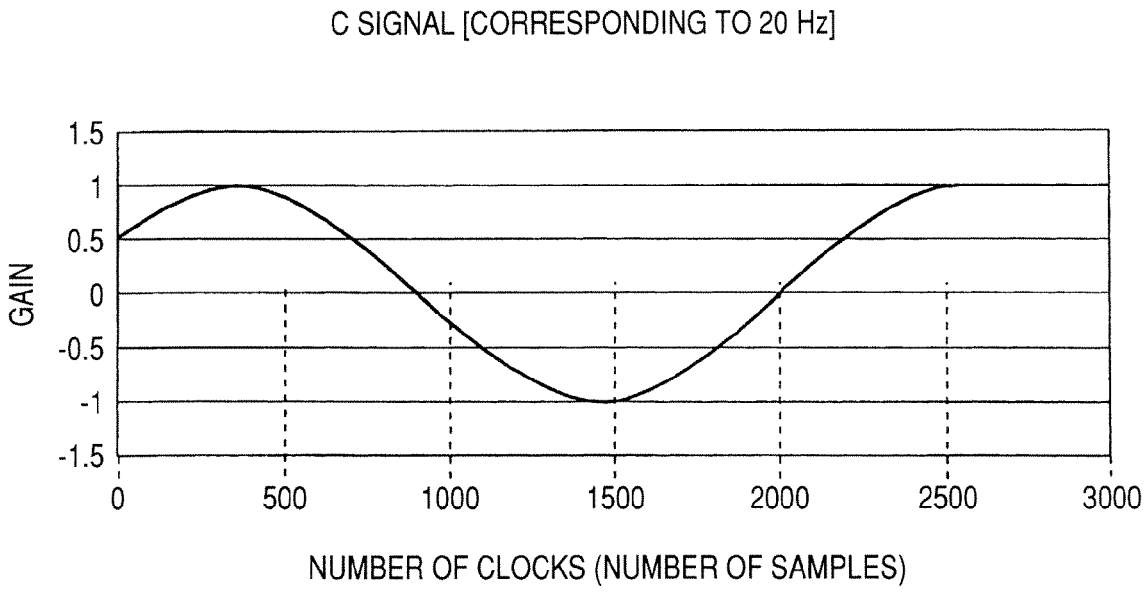
FIG. 5 is a view illustrating an example of a waveform of a third sine wave signal generated by mixing the first sine wave signal and the second sine wave signal.

On the other hand, since the C signal shown in FIG. 5 is a signal corresponding to 20 Hz, the length of one period becomes larger than 2000 clocks (about 45 msec and an operating frequency is 44.1 kHz in this case). As a result, by means of the C signal, it is possible to measure long delay time, which cannot be measured in the case of the A and B signals.

Referring to FIG. 3, after obtaining the C signal by the mixing process described above, the delay time DT is measured as shown by <6> in the drawing. That is, the delay time DT, which is sound arrival delay time from the speaker SP to the microphone M1, is obtained by measuring (performing timing measurement on) deviation starting from a 0-th clock with respect to the C signal, the 0-th clock corresponding to the waveform start position of the C signal. For example, in the example shown in FIG. 5, the measurement can be made over the range of the 0-th clock to the 2000th clock corresponding to the start position of a waveform.

Furthermore, as shown by <7> in FIG. 3, a delay time adjustment is performed on the basis of the delay time DT that has been measured as described above. That is, as described above as the delay process for each channel performed by the sound signal processing unit 10*d* in FIG. 2, a delay time adjustment for each speaker channel is performed by the control unit 10.

As described above, in the method of measuring delay time according to the embodiment, since the delay time is measured on the basis of the C signal, which is obtained by mixing the A and B signals and has a frequency corresponding to the difference between frequencies of the A and B signals, it is possible to measure delay time longer than delay time that can be measured on the basis of the A and B signals.

Accordingly, it is possible to measure long delay time without being limited to a frequency of a sine wave signal output from the speaker SP. That is, according to the method described above, the delay time can be measured without being limited to the type of the speaker SP that is used.

In addition, in order to measure the delay time in the present embodiment, a process of mixing sine wave signals is needed unlike in the method used in the related art. However, as for the mixing process, it is sufficient to perform a relatively simple operation based on the equation using trigonometric function. Therefore, as can be understood in the above description, a complex process, such as FFT (fast Fourier transform) or IFFT (inverse fast Fourier transform) as in the case using a TSP (Time Stretched Pulse) signal, is not required.

Thus, in the above-described method according to the embodiment, a high-performance processing capability is not needed, and accordingly, the method can be properly applied to even an apparatus having relatively insufficient hardware resources.

Subsequently, processes to be performed in order to realize the measuring operation, which has been described above in the first embodiment, will be described with reference to flow charts shown in FIGS. 6 and 7.

Figure 6:
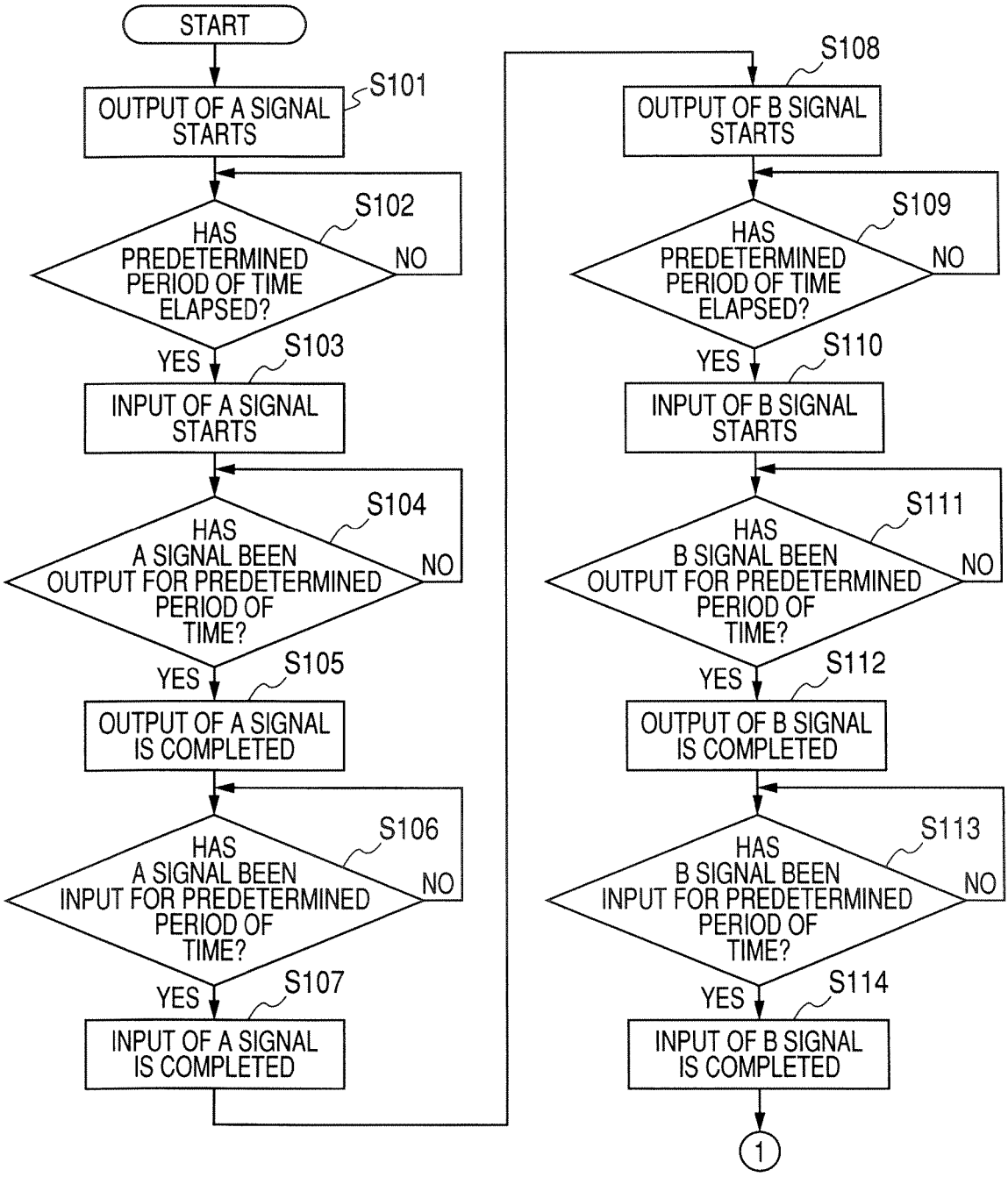
FIG. 6 is a flow chart illustrating processes for realizing the operation of measuring delay time according to the first embodiment.
Figure 7:
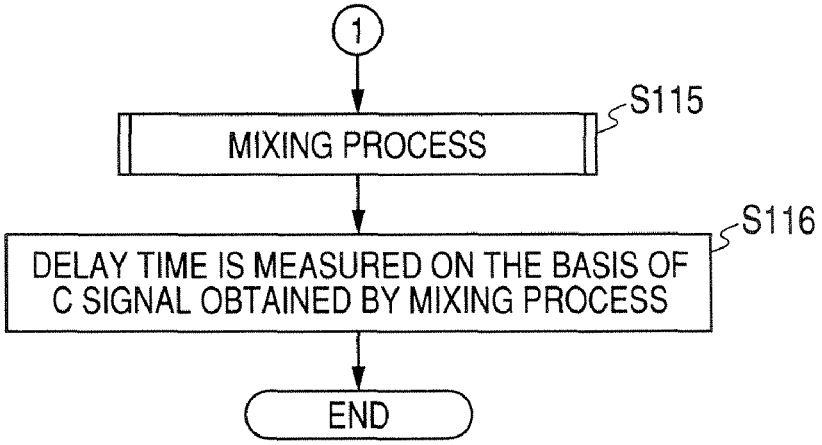
FIG. 7 is a flow chart illustrating processes for realizing the operation of measuring delay time according to the first embodiment.

In addition, the processes shown in FIGS. 6 and 7 are executed by a program stored in, for example, a ROM included in the control unit 10 shown in FIG. 1 (and FIG. 2).

Referring to FIG. 6, first, in step S101, output of an A signal starts.

Then, in step S102, it is waited until a predetermined period of time elapses from the output start of the A signal, and then in step S103, input of the A signal starts. That is, input of a collected signal corresponding to the A signal starts.

Here, as described above in FIG. 3, in the present embodiment, the input start timing of the collected signal is set to be synchronized with a start timing of one period of an output signal. That is, as described above, it is waited until the A signal is output for a predetermined period of time in step S102 and then the input of the collected signal corresponding to the A signal starts in step S103, and thus the input start timing of the collected signal is synchronized with the start timing of one period of the output signal.

Further, in the present embodiment, since the input start timing of the collected signal is synchronized with the start timing of one period of the output signal, the delay time DT can be easily obtained by measuring deviation, starting from the 0-th clock, of the waveform start position of the mixed C signal.

In this case, if it is not necessary to consider easiness described above, the input start timing of the collected signal does not necessarily need to be synchronized with the start timing of one period of the output signal. That is, even though respective start timings are not synchronized, if a deviation amount of each of the respective start timings is known beforehand, the same measurement result can be obtained by adding (or subtracting) a value corresponding to the deviation amount with respect to delay time, which is measured in the same manner from the 0-th clock of the C signal generated by the mixing process.

Subsequently, in step S104, it is waited until the A signal is output for a predetermined period of time, and then in step S105, the output of the A signal is completed. That is, in the steps S104 and S105, the A signal that started to be output in step S101 is continuously output for the predetermined period of time.

Similarly, in subsequent step S106, it is waited until the A signal is input for a predetermined period of time, and then in step S107, the input of the A signal is completed. Thus, the A signal that started to be input in step S103 is continuously input for the predetermined period of time.

Then, the output process on the A signal and the input process on the collected signal corresponding to the A signal, which are shown in steps S101 to S107, are also performed for the B signal in subsequent steps S108 to S114.

That is, output of the B signal starts in step S108, it is waited until a predetermined period of time elapses in step S109, and then input of the B signal starts in step S110. Thereafter, in step S111, it is waited until the B signal is output for a predetermined period of time, and then in step S112, the output of the B signal is completed. Then, in subsequent step S113, it is waited until the B signal is input for a predetermined period of time, and then in step S114, the input of the B signal is completed.

Then, after completing the input of the B signal, a mixing process is performed in step S115 shown in FIG. 7.

Figure 8:
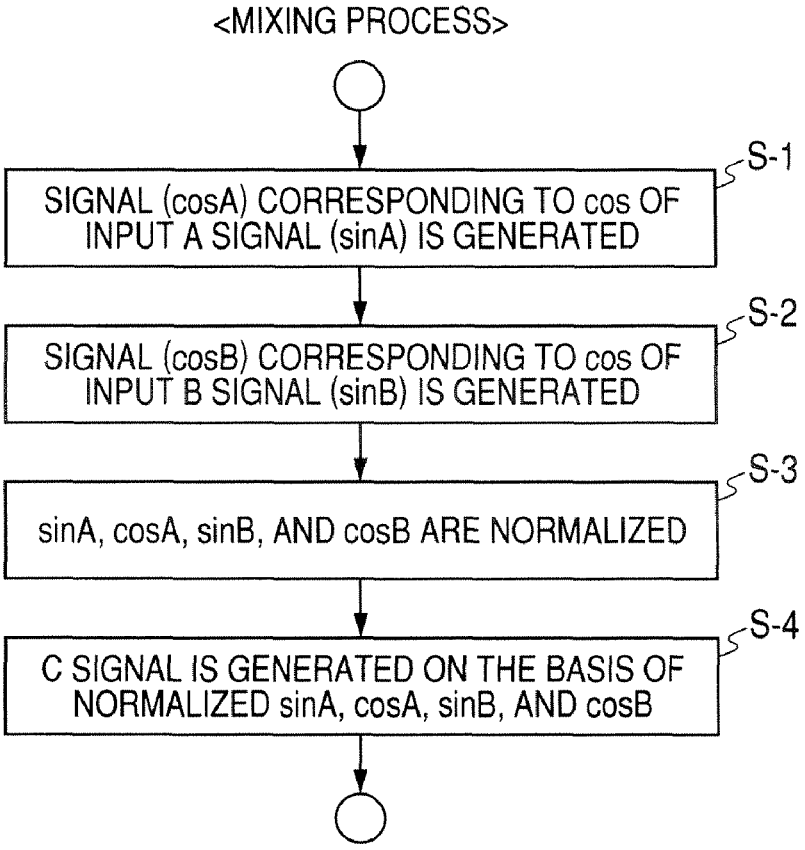
FIG. 8 is a flow chart illustrating details of a mixing process.

Specifically, in the mixing process, processes S-1 to S-4 shown in FIG. 8 are performed.

Referring to FIG. 8, first, in step S-1, a signal (cos A) corresponding to cos of the input A (sin A) signal is generated. That is, a signal deviating from the input A signal by ¼ wavelength is generated. Then, in step corresponding to cos of the input B signal is generated by generating a signal deviating from the input B signal (sin B) by ¼ wavelength.

Then, in step S-3, sin A, cos A, sin B, and cos B are normalized so as to have predetermined wavelengths, and then in step S-4, a C signal is generated on the basis of the normalized sin A, cos A, sin B, and cos B. That is, the C signal as 'Sin $\{2\pi(a-b)x/T\}$' is obtained by performing an operation, in which the above-mentioned equation 1 is used, with respect to '$\sin(2\pi ax/T)$', '$\cos(2\pi ax/T)$', '$\sin(2\pi bx/T)$', and '$\cos(2\pi bx/T)$' as the normalized sin A, cos A, sin B, and cos B.

Referring to FIG. 7, after obtaining the C signal by the mixing process described above, the delay time is measured on the basis of the C signal in step S116. That is, in this case, the delay time DT, which is the sound arrival delay time from the speaker SP to the microphone M1, is obtained by measuring deviation, starting from the 0-th clock, of the waveform start position of the C signal.

Further, in FIGS. 6 and 7, the processes of measuring the delay time with respect to only one speaker the delay time DT2 with respect to each speaker, one of the plurality of speakers SP (in this case, SP1 to SP4) may be sequentially selected and the processes shown in FIGS. 6 and 7 may be sequentially performed for the selected speaker SP. Thus, it is possible to obtain the delay time DT with respect to each speaker SP.

The delay time DT2 with respect to each speaker SP, which has been obtained as described above, is used for adjustment of delay time for each speaker SP performed by the control unit 10, in the same manner as described above as the delay process for each channel performed by the sound signal processing unit 10*d* in FIG. 2. That is, the control unit 10 sets delay time with respect to an audio signal, which is reproduced by the media reproducing unit 14 and is output from each speaker SP, on the basis of the delay time DT measured for each speaker SP, and then performs a delay process on each audio signal according to the set delay time.

At this time, the delay time for each channel is set such that sound arrival time from the respective speakers SP to the microphone M1 becomes equal to one another. Accordingly, in the case when the position where the microphone M1 is disposed is set to the listening position, it is possible to cause sounds output from the respective speakers SP to arrive at the listening position at the same time.

In addition, the above-described method, in which the delay time DT with respect to each speaker SP is measured and then the delay adjustment with respect to an audio signal for each channel is performed on the basis of each delay time DT, is also applied to subsequent embodiments (and modification) in the same manner.

Moreover, in the above description, the input A and B signals have been used in the mixing process without any process on the input A and B signals; however, in an actual case of measuring delay time, a noise generated due to a measuring environment may cause a trouble. In other words, if the input A and B signals include noises, measurement precision may be lowered.

For this reason, a band pass filter, in which frequencies of the A and B signals are set as a pass band, may be used for the collected signal, such that the A and B signals from which noises are removed can be extracted.

Specifically, as shown by a dotted line in FIG. 2, for example, the control unit 10 may be configured to have a function as a filtering process unit 10*e*. Preferably, the filtering process unit 10*e* is configured to perform a filtering process on the collected signal input from the A/D converter 12, with the set frequency as a pass band. Specifically, in this case, as for the input A signal, the filtering process is performed in a state in which the frequency (320 Hz) of the A signal is set as the pass band. Further, as for the B signal, the filtering process is performed in a state in which the frequency (300 Hz) of the B signal is set as the pass band.

Here, for example, in the case of a method of using a TSP signal, since the TSP signal includes signals over almost all of the bands, it is difficult to remove noises generated due to measurement environment by performing an extracting process using the band pass filter described above. That is, in the method of using the TSP signal, it is difficult to improve the measurement precision by reducing noises.

On the other hand, in the method according to the present embodiment, since each signal to be input (acquired) corresponds to only one frequency band, it is possible to remove the noises by performing the filtering process described above. Thus, it is possible to easily improve precision when measuring the delay time.

Second Embodiment

Figure 9:
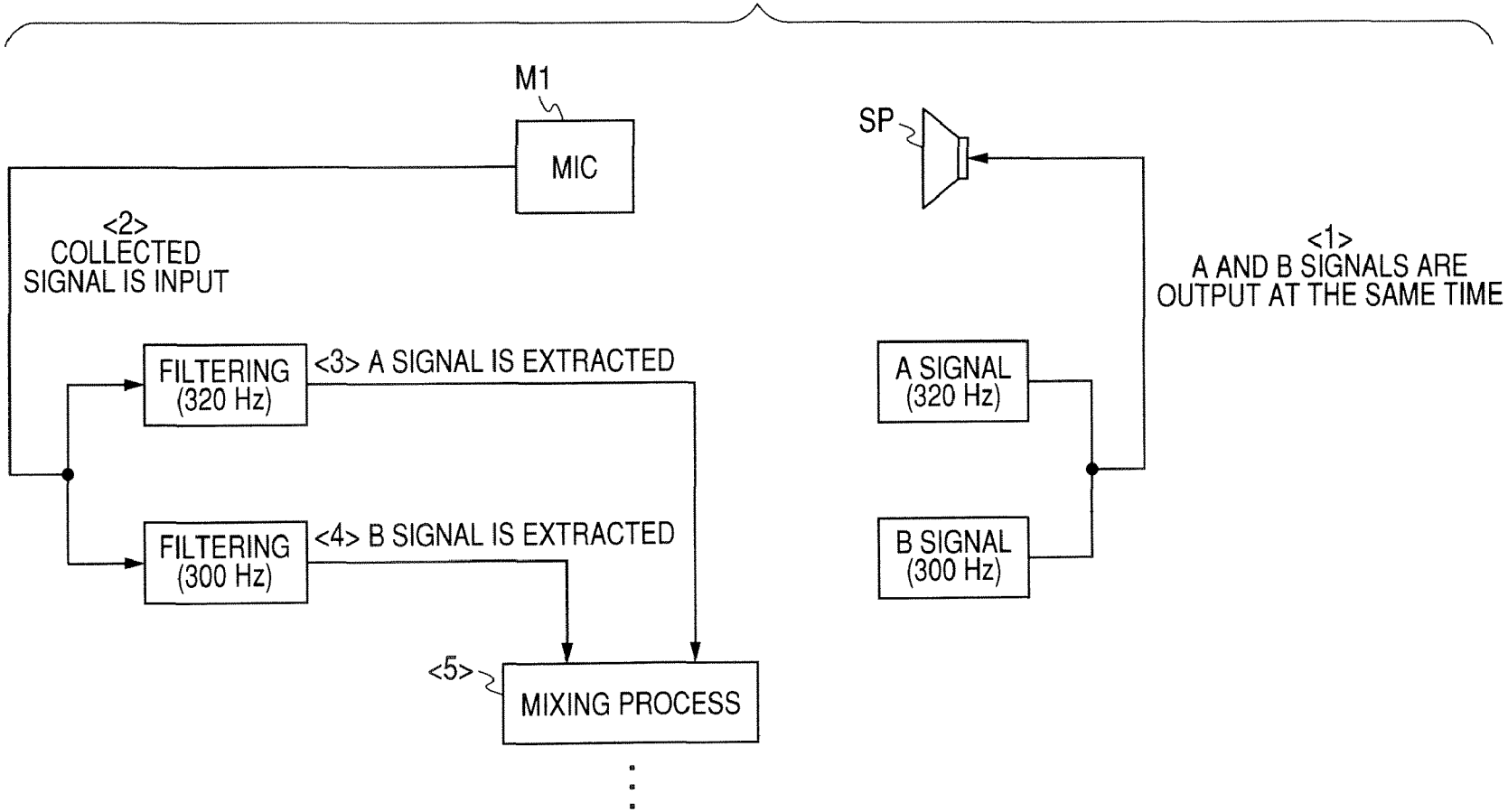
FIG. 9 is a view schematically explaining an operation of measuring delay time according to a second embodiment.

FIG. 9 is a view schematically illustrating an operation of measuring delay time according to a second embodiment.

In the second embodiment, A and B signals are set to be output at the same time, as compared with the first embodiment in which the A and B signals are separately output.

Here, in order to perform a mixing process, these A and B signals need to be acquired as separate signals. Therefore, in the second embodiment, a band pass filter, which is provided to separately output the A and B signals that are output at the same time such that the A and B signals can be acquired as separate signals, is needed. That is, in this case, the control unit 10 includes the filtering process unit 10*e* described above.

Hereinafter, the operation according to the second embodiment will be specifically described. First, as shown by <1> in FIG. 9, the A and B signals are output at the same time. For example, the simultaneous output is made by outputting a signal, which is generated by adding the A and B signals, from one speaker SP.

Then, a collected signal corresponding to the signals that have been simultaneously output from one speaker SP is input (<2> in FIG. 9). Then, a filtering process, in which an A signal frequency (320 Hz) and a B signal frequency (300 Hz) are set as pass bands, is performed for the input signals so as to extract the A and B signals (<3> and <4> in FIG. 9). By performing the extracting process described above, the A and B signals that have been output at the same time can be acquired as separate signals, respectively, in the same manner as in the first embodiment.

Thereafter, as shown by <5> in FIG. 9, the mixing process, which is the same as in the first embodiment, is performed for the A and B signals, thereby generating the C signal. Then, after obtaining the C signal, the delay time DT is measured by performing the same operation as in the first embodiment.

According to the second embodiment described above, the number of output sine wave signals required to measure delay time is reduced to half of that in the first embodiment. As a result, it is possible to reduce the time required for measurement.

Further, in the embodiment, since the method of extracting each signal by using a band pass filter is used, it is possible to improve the precision when measuring the delay time.

Figure 10:
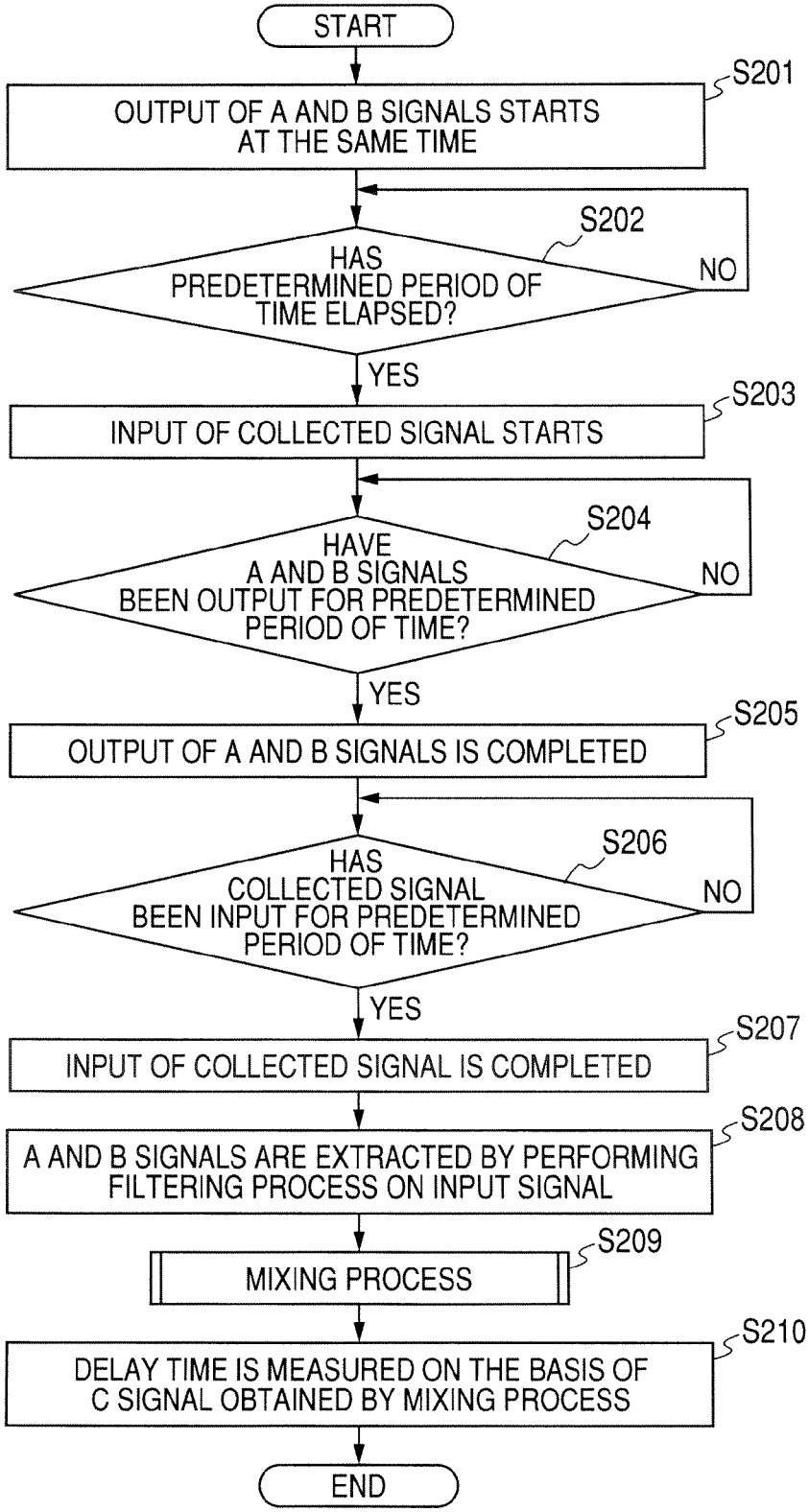
FIG. 10 is a flow chart illustrating processes for realizing the operation of measuring delay time according to the second embodiment.

FIG. 10 is a flow chart explaining processes to be performed in order to realize a delay time measuring operation according to the second embodiment. In addition, the processes shown in FIG. 10 are executed by a program stored in, for example, a ROM included in the control unit 10 shown in FIG. 1 (and FIG. 2).

In this case, first, in step S201, output of the A and B signals starts at the same time. That is, output of a signal obtained by adding the A and B signals starts.

Then, even in this case, in step S202, it is waited until a predetermined period of time elapses from the signal output start, and then in step S203, input of the collected signal starts. Even in this case, the input start timing of the collected signal is set to be synchronized with a start timing of one period of an output signal.

Subsequently, in step S204, it is waited until the A and B signals are output for a predetermined period of time, and then in step S205, the output of the A and B signals are completed. That is, in the steps S204 and step S201 are continuously output for the predetermined period of time.

Similarly, in subsequent step S206, it is waited until the collected signal is input for a predetermined period of time, and then in step S207, the input of the collected signal is completed. Thus, the collected signal that started to be input in step S203 is continuously input for the predetermined period of time.

Then, in step S208, a filtering process is performed for the input signal, thereby extracting the A and B signals. Subsequently, in step S209, the A and B signals extracted as described above are mixed by the mixing process, and then in step S210, delay time is measured on the basis of the C signal obtained by the mixing process.

In addition, the processes performed in steps S208 and S209 are the same as those in steps S115 and S116 described above, and thus explanation thereof is omitted herein.

Third Embodiment

A third embodiment is an application of the second embodiment. In the third embodiment, sine wave signals having different frequencies are simultaneously output from a plurality of speakers SP. Even in the third embodiment, the control unit 10 includes the filtering process unit 10*e* that is provided to extract sine wave signals included in a collected signal.

For example, in the third embodiment, a case is exemplified in which sine wave signals are simultaneously output from all of the speakers SP. Specifically, in this case, an A1 signal (320 Hz) and a B1 signal (300 Hz) are output from the speaker SP1, an A2 signal (360 Hz) and a B2 signal (340 Hz) are output from the speaker SP2, an A3 signal (400 Hz) and a B3 signal (380 Hz) are output from the speaker SP3, and an A4 signal (440 Hz) and a B4 signal (420 Hz) are output from the speaker SP4.

At this time, a frequency of each of the signals is selected such that signals having the same frequency are not included in the signals that are output at the same time. This is because, in the case when sine wave signals are simultaneously output from the respective speakers SP, the delay time DT cannot be properly measured if signals having the same frequency are output from the plurality of speakers SP.

Thus, the signals are output from all of the speakers SP at the same time, and signals, which are collected by the microphone M1 and include a plurality of frequency signals, are input. Then, the respective signals are extracted by performing a filtering process with each of the frequencies of the signals A1, B1, A2, B2, A3, B3, A4, and B4 as a pass band.

Thereafter, a mixing process is performed with respect to two signals output from each speaker SP, thereby obtaining a C signal. Then, each delay time DT is measured on the basis of the C signal obtained for each speaker SP.

Here, a C signal, which is obtained by mixing the A1 and B1 signals output from the speaker SP1, is called a C1 signal. In the same manner, a C signal obtained by mixing the A2 and B2 signals output from the speaker SP2, is called a C2 signal, a C signal obtained by mixing the A3 and B3 signals output from the speaker SP3, is called a C3 signal, and a C signal obtained by mixing the A4 and B4 signals output from the speaker SP4, is called a C4 signal.

According to the third embodiment described above, it is enough that sine wave signals are simultaneously output only once from all of the speakers SP in order to measure the delay time. As a result, as compared with the method according to the second embodiment described above, time required to output sine wave signals for measurement can be reduced to ¼ corresponding to the number of speakers in this case. In addition, as compared with the method according to the first embodiment described above, the time required to output sine wave signals for measurement can be reduced to ⅛, which is ½ of ¼.

Further, even in the embodiment, since the method of extracting each signal by using a band pass filter is used, it is possible to improve the precision when measuring the delay time.

Figure 11:
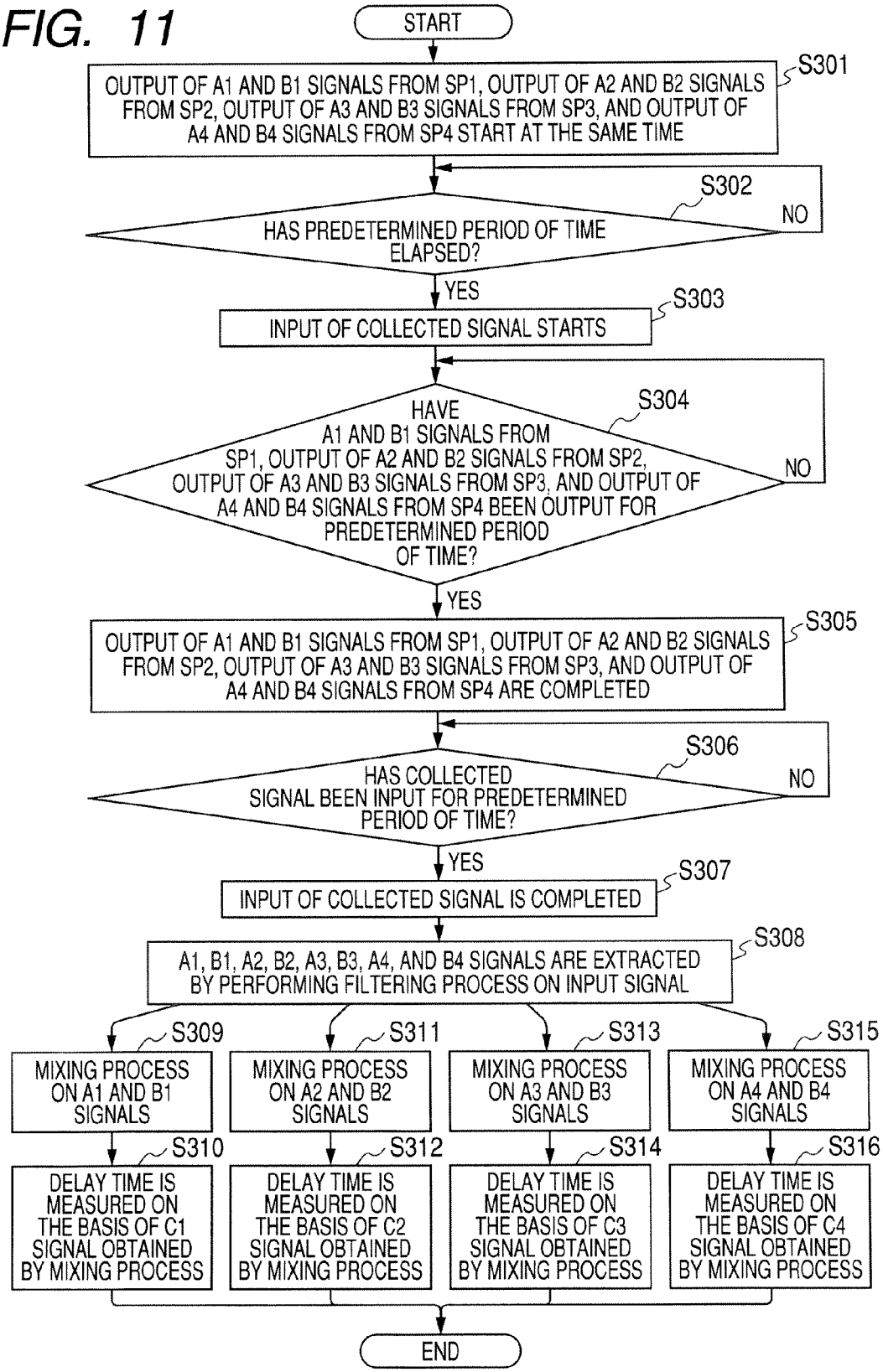
FIG. 11 is a flow chart illustrating processes for realizing an operation of measuring delay time according to a third embodiment.

FIG. 11 is a flow chart illustrating processes to be performed in order to realize a delay time measuring operation according to the third embodiment.

In addition, even the processes shown in FIG. 11 are executed by a program stored in, for example, a ROM included in the control unit 10 shown in FIG. 1 (and FIG. 2).

First, in step S301, the sine wave signals are simultaneously output from all of the speakers SP such that the A1 signal and the B1 signal are output from the speaker SP1, the A2 signal and the B2 signal are output from the speaker SP2, the A3 signal and the B3 signal are output from the speaker SP3, and the A4 signal and the B4 signal are output from the speaker SP4. Specifically, a signal obtained by adding the A1 and B1 signals, a signal obtained by adding the A2 and B2 signals, a signal obtained by adding the A3 and B3 signals, and a signal obtained by adding the A4 and B4 signals are simultaneously output from the speakers SP1, SP2, SP3, and SP4, respectively.

Then, even in this case, in step S302, it is waited until a predetermined period of time elapses from the simultaneous output start, and then in step S303, input of the collected signal starts.

Even in this case, the input start timing of the collected signal is set to be synchronized with a start timing of one period of an output signal.

Subsequently, in step S304, it is waited until the signals, which have been simultaneously output, are output for a predetermined period of time, and then in step S305, the simultaneous output is completed. That is, even in this case, in the steps S304 and S305, the simultaneous output that started in step S301 is continued for the predetermined period of time.

Similarly, in subsequent step S306, it is waited until the collected signal is input for a predetermined period of time, and then in step S307, the input of the collected signal is completed. Thus, the input of the collected signal, which started in step S303, is continued for the predetermined period of time.

Then, in step S308, a filtering process is performed for the input signal, thereby extracting the A1, B1, A2, B2, A3, B3, A4, and B4 signals. That is, in this case, a filtering process, in which 320 Hz and 300 Hz are set as pass bands, is performed for the input signals so as to extract the A1 and B1 signals. Similarly, a filtering process, in which 360 Hz and 340 Hz are set as pass bands, is performed for the input signals so as to extract the A2 and B2 signals, and a filtering process, in which 400 Hz and 380 Hz are set as pass bands, is performed for the input signals so as to extract the A3 and B3 signals. In addition, a filtering process, in which 440 Hz and 420 Hz are set as pass bands, is performed for the input signals so as to extract the A4 and B4 signals.

Thereafter, mixing processes S309, S311, S313, and the A2 and B2 signals, the A3 and B3 signals, and the A4 and B4 signals that have been extracted corresponding to the respective speaker SP, thereby obtaining the C1 signal, the C2 signal, C3 signal, and C4 signal. Then, the delay time DT corresponding to each speaker SP is measured on the basis of each of the signals C1, C2, C3, and C4 (S310, S312, S314, and S316).

In addition, the mixing processes and the delay time measuring processes are the same as those in steps S115 and S116 described above, and thus explanation thereof is omitted herein.

Furthermore, in the embodiment, the mixing processes are illustrated to be performed in parallel with the delay time measuring processes S310, S312, S314, and S316, for the convenience of illustration. However, the mixing processes and the delay time measuring processes for the respective speakers SP may be performed, for example, in the order of speakers SP1->SP2->SP3->SP4, such that the mixing process and the delay time measuring process for each speaker SP are performed in the order.

In addition, in the third embodiment, a case in which sine wave signals are simultaneously output from all of the speakers SP has been described. However, for example, in the case when the audio system 1 serves as a car audio system and a measuring process is performed separately for front two channels and rear two channels, sine wave signals may be simultaneously output with respect to two speakers SP corresponding to the front two channels so as to measure delay time and then sine wave signals may be simultaneously output with respect to two speakers SP corresponding to the rear two channels so as to measure delay time. That is, it is not necessary to output the sine wave signals from all of the speakers SP.

While the embodiments of the invention have been described, the invention is not limited to the embodiments described above.

For example, in each of the embodiments described above, an operation according to a following modification may be performed.

That is, in the modification, delay time is not measured only once with respect to each speaker SP, but a plural number of delay time measurements are performed instead of the combination of frequencies of sine wave signals to be output and then the final delay time DT is obtained on the basis of the plural number of delay time measurement results.

Specifically, for example, an A signal having a frequency of 320 Hz and a B signal having a frequency of 300 Hz are output to measure delay time, and then the delay time measurement is again performed instead of outputting, for example, an A signal having a frequency of 360 Hz and a B signal having a frequency of 340 Hz obtained by changing the frequencies of the A and B signals, thus repeatedly performing a predetermined number of operations of measuring delay time. Then, on the basis of the plurality of delay time measurement results obtained as described above, for example, an average value of thereof is obtained as a final delay time DT.

For example, in the case when measurement is performed only once, if the measurement is affected by noises or the like generated due to measurement environment, the result affected by the noises or the like is obtained as the delay time DT. As a result, the measurement cannot be properly performed. However, for example, by means of the average value of the plurality of measurement results, it is possible to obtain an even more proper delay time DT. In addition, since the plural number of measurements is performed instead of the combination of frequencies of sine wave signals to be output, it is possible to perform stable delay time measurement with less effects of frequency characteristics with respect to measurement environment.

Figure 12:
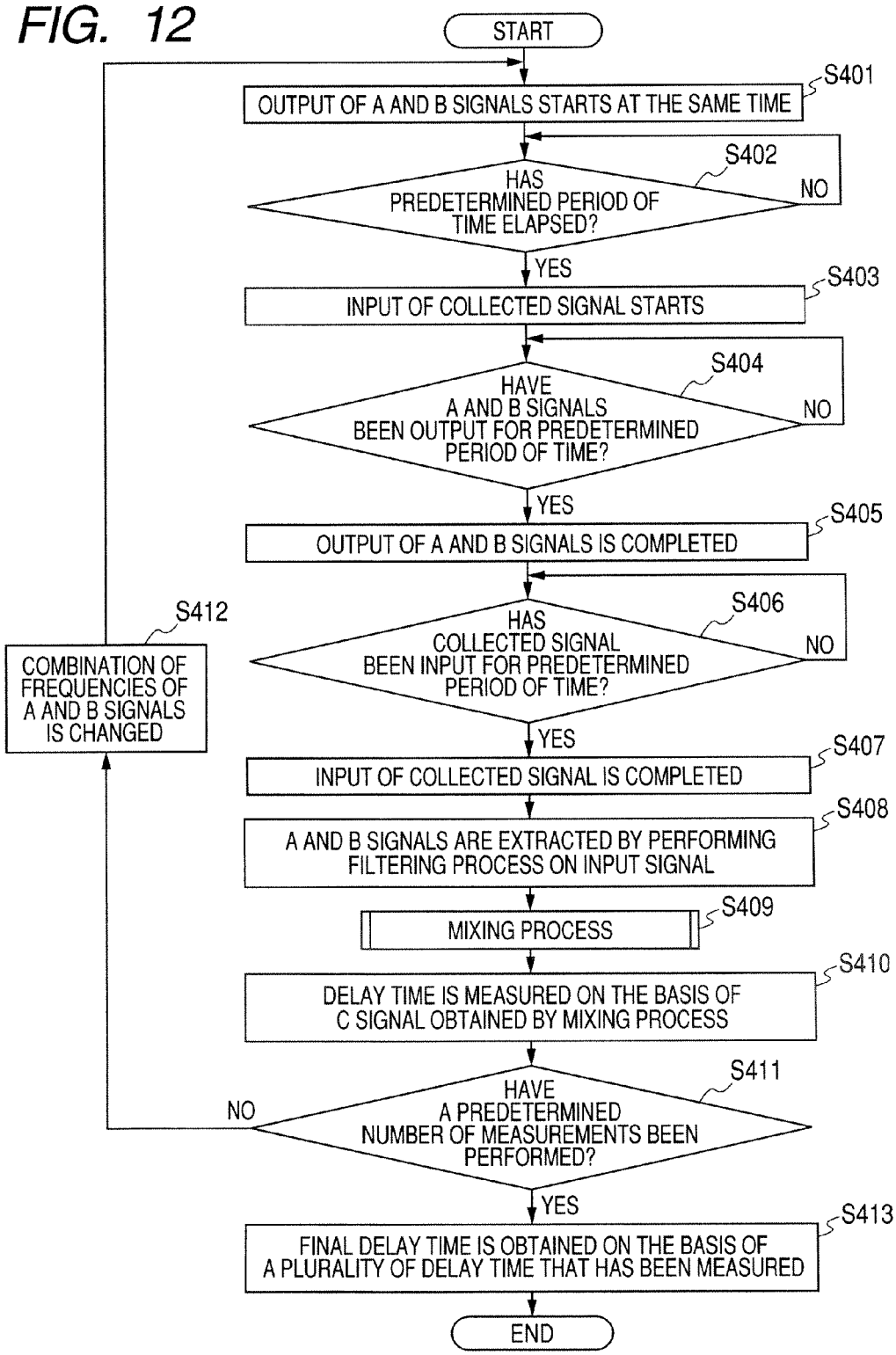
FIG. 12 is a flow chart illustrating processes for realizing an operation of measuring delay time according to a modification of the embodiments.

FIG. 12 is a flow chart illustrating a process of realizing an operation according to the modification described above. In addition, even the processes shown in FIG. 12 are executed by a program stored in, for example, a ROM included in the control unit 10.

FIG. 12 exemplifies a process to be performed when the modification is applied to the second embodiment.

Since the case shown in FIG. 12 illustrates an example in which the modification is applied to the second embodiment, first, in steps S401 to S410, the same processes as in steps S201 to S210 shown in FIG. 10 are performed. That is, a process of measuring delay time is performed on the basis of the A and B signals that have been simultaneously output from one speaker SP.

After measuring the delay time, in step S411, a determination process on whether a predetermined number of measurements have been performed is performed. If a negative result is obtained since a predetermined number of measurements have not performed, the process proceeds to step S412 in which a process of changing a combination of frequencies of the A and B signals is performed. Then, returning to step S401, the delay time measurement is again performed on the basis of an output result of the A and B signals whose frequencies have been changed as described above.

Thereafter, if a positive result is obtained since a predetermined number of measurements have performed in step S411, a final delay time is obtained on the basis of the plurality of delay time that has been measured in step value of the plurality of delay time is calculated, and the calculated average value is obtained as a final delay time.

Further, in the case when the modification is applied to the first embodiment, preferably, processes corresponding to steps S411 to S413 described above may be additionally performed subsequent to step S116 shown in FIG. 7. In this case, after performing the process corresponding to step S412, the process returns to step S101 shown in FIG. 6.

Furthermore, in the case when the modification is applied to the third embodiment, preferably, processes corresponding to steps S411 to S413 described above may be additionally performed subsequent to the delay time measuring processes S310, S312, S314, and S316 for the respective speakers SP as shown in FIG. 11. In this case, after performing the process corresponding to step S412, the process returns to step S301 shown in FIG. 11.

Moreover, in each of the embodiments described above, the values selected as the frequencies of sine wave signals are only examples, and the values are not limited to the values.

Further, in FIG. 1, the media reproducing unit 14 reproduces audio signals from a recording medium. However, the media reproducing unit 14 may be configured as an AM/FM tuner that outputs audio signals by receiving and demodulating AM/FM broadcast signals.

Furthermore, in the reproducing device 2, a case of performing reproduction (including receiving and demodulation) of an audio signal has been exemplified. However, the reproducing device 2 may be configured to be able to reproduce even a video signal in correspondence with a recording medium or a television broadcast in which the video signal is recorded together with the audio signal. In this case, the reproducing device 2 is configured to output a video signal in synchronization with an audio signal.

Furthermore, the sound signal processing apparatus according to the embodiment of the invention is configured to include the media reproducing unit 14 described above such that the sound signal processing apparatus has a reproduction function with respect to a recording medium or a function of receiving a broadcast signal. In addition, the sound signal processing apparatus may be configured as, for example, an amplifier apparatus where a sound signal that is reproduced (received) from the outside is input and a delay time adjustment is performed on the basis of delay time measured with respect to the input sound signal.

It should be understood by those skilled in the art that various modifications, combinations, sub-combinations and alterations may occur depending on design requirements and other factors insofar as they are within the scope of the appended claims or the equivalents thereof.

What is claimed is:

1. A measuring apparatus that measures sound arrival delay time from a speaker to a microphone on the basis of a result obtained by collecting signals output from the speaker by means of the microphone, comprising:

measuring means for measuring the sound arrival delay time that makes a control such that a first sine wave signal having a first frequency and a second sine wave signal having a second frequency different from the first frequency are output from the speaker, the first sine wave signal and the second sine wave signal are collected by the microphone and the first sine wave signal and the second sine wave signal are mixed so as to generate a third sine wave signal having a frequency corresponding to a difference between the first frequency and the second frequency, and said measuring means measures the sound arrival delay time on the basis of the third sine wave signal.

2. The measuring apparatus according to claim 1, wherein the measuring means makes a control such that the first sine wave signal and the second sine wave signal are simultaneously output from the speaker, and is input with signals collected by the microphone and then performs a filtering process on the collected signals with the first frequency and the second frequency as a pass band, thereby extracting the first sine wave signal and the second sine wave signal.

3. The measuring apparatus according to claim 1, wherein a plurality of speakers are provided, and the measuring means makes a control such that the first sine wave signal and the second sine wave signal are simultaneously output from the plurality of speakers; is input with signals collected by the microphone and then performs a filtering process on the collected signals with frequencies of the first sine wave signal and the second sine wave signal, which have been output from each of the plurality of speakers, as a pass band, thereby extracting the first sine wave signal and the second sine wave signal corresponding to each of the plurality of speakers; generates a third sine wave signal corresponding to each of the plurality of speakers by mixing the first sine wave signal and the second sine wave signal extracted in correspondence with each of the plurality of speakers; and measures the sound arrival delay time corresponding to each of the plurality of speakers on the basis of the third sine wave signal.

4. The measuring apparatus according to claim 1, wherein the sound arrival delay time is measured a plural number of times instead of a combination of frequencies of the first and second sine wave signals, and final sound arrival delay time is obtained on the basis of the plural number of measurement results.

5. A measuring method of measuring sound arrival delay time from a speaker to a microphone on the basis of a result obtained by collecting signals output from the speaker by means of the microphone, comprising the steps of:

outputting, from the speaker, a first sine wave signal having a first frequency and a second sine wave signal having a second frequency different from the first frequency;

inputting the first sine wave signal and the second sine wave signal collected by the microphone, and then mixing the first sine wave signal and the second sine wave signal so as to generate a third sine wave signal having a frequency corresponding to a difference between the first frequency and the second frequency; and measuring the sound arrival delay time on the basis of the third sine wave signal.

6. A sound signal processing apparatus having a measuring function of measuring sound arrival delay time from a speaker to a microphone on the basis of a result obtained by collecting signals output from the speaker by means of the microphone, comprising:

measuring means for measuring the sound arrival delay time that makes a control such that a first sine wave signal having a first frequency and a second sine wave signal having a second frequency different from the first frequency are output from the speaker, the first sine wave signal and the second sine wave signal are collected by the microphone and the first sine wave signal and the second sine wave signal are mixed so as to generate a third sine wave signal having a frequency corresponding to a difference between the first frequency and the second frequency, and said measuring means measures the sound arrival delay time on the basis of the third sine wave signal; and a delay time adjustment unit that adjusts delay time with respect to sound signals, which are to be output from the speaker, on the basis of the sound arrival delay time measured by the measuring means.

7. A measuring apparatus that measures sound arrival delay time from a speaker to a microphone on the basis of a result obtained by collecting signals output from the speaker by means of the microphone, comprising:

a measuring unit configured to measure the sound arrival delay time that makes a control such that a first sine wave signal having a first frequency and a second sine wave signal having a second frequency different from the first frequency are output from the speaker, the first sine wave signal and the second sine wave signal are collected by the microphone and the first sine wave signal and the second sine wave signal are mixed so as to generate a third sine wave signal having a frequency corresponding to a difference between the first frequency and the second frequency, and the measuring unit measures the sound arrival delay time on the basis of the third sine wave signal.

8. A sound signal processing apparatus having a measuring function of measuring sound arrival delay time from a speaker to a microphone on the basis of a result obtained by collecting signals output from the speaker by means of the microphone, comprising:

a measuring unit configured to measure the sound arrival delay time that makes a control such that a first sine wave signal having a first frequency and a second sine wave signal having a second frequency different from the first frequency are output from the speaker, the first sine wave signal and the second sine wave signal are collected by the microphone and the first sine wave signal and the second sine wave signal are mixed so as to generate a third sine wave signal having a frequency corresponding to a difference between the first frequency and the second frequency, and said measuring unit measures the sound arrival delay time on the basis of the third sine wave signal; and a delay time adjustment unit that adjusts delay time with respect to sound signals, which are to be output from the speaker, on the basis of the sound arrival delay time measured by the measuring unit.

* * * * *